US010806986B2

(12) United States Patent
Moore et al.

(10) Patent No.: US 10,806,986 B2
(45) Date of Patent: Oct. 20, 2020

(54) BALL RETURN DEVICE AND METHOD OF USING

(71) Applicant: APQS, LLC, Carroll, IA (US)

(72) Inventors: Nathaniel Moore, Carroll, IA (US); Mike Moore, Carroll, IA (US)

(73) Assignee: APQS, LLC, Carroll, IA (US)

( * ) Notice: Subject to any disclaimer, the term of this patent is extended or adjusted under 35 U.S.C. 154(b) by 0 days.

(21) Appl. No.: 16/540,860

(22) Filed: Aug. 14, 2019

(65) Prior Publication Data

US 2019/0388763 A1 Dec. 26, 2019

Related U.S. Application Data

(63) Continuation of application No. 15/471,925, filed on Mar. 28, 2017, now Pat. No. 10,421,001.

(60) Provisional application No. 62/315,095, filed on Mar. 30, 2016.

(51) Int. Cl.

| | |
|---|---|
| ***A63B 69/00*** | (2006.01) |
| ***A63B 69/40*** | (2006.01) |
| ***A63B 47/02*** | (2006.01) |
| *A63B 71/02* | (2006.01) |
| *A63B 24/00* | (2006.01) |

(52) U.S. Cl.

CPC ..... *A63B 69/406* (2013.01); *A63B 47/02* (2013.01); *A63B 69/0071* (2013.01); *A63B 2024/0025* (2013.01); *A63B 2071/025* (2013.01); *A63B 2208/0204* (2013.01); *A63B 2210/50* (2013.01); *A63B 2220/13* (2013.01); *A63B 2220/805* (2013.01); *A63B 2220/806* (2013.01); *A63B 2220/833* (2013.01); *A63B 2225/09* (2013.01); *A63B 2225/093* (2013.01)

(58) Field of Classification Search

CPC ..... A63B 69/406; A63B 69/0071; A63B 2208/0204

USPC ..... 473/422, 451, 433–436; 124/78, 79, 56

See application file for complete search history.

(56) References Cited

U.S. PATENT DOCUMENTS

| | | | | |
|---|---|---|---|---|
| 4,193,591 A | | 3/1980 | Paulson | |
| 4,678,189 A | | 7/1987 | Koss | |
| 4,714,248 A | | 12/1987 | Koss | |
| 4,917,500 A | * | 4/1990 | Lugos | G01J 3/50 356/406 |
| 4,956,775 A | | 9/1990 | Klamer et al. | |

(Continued)

FOREIGN PATENT DOCUMENTS

| | | |
|---|---|---|
| FR | 2659022 | 9/1991 |
| KR | 101600761 | 3/2016 |

(Continued)

*Primary Examiner* — Mitra Aryanpour

(74) *Attorney, Agent, or Firm* — Nyemaster Goode, PC

(57) ABSTRACT

A device and method for aiding in the practice of basketball and other games that require a ball to be returned to a player in order to perform repetitive practice routines. The device generally includes a ball catching component and a ball ejection component. The ball catching component catches balls thrown by the player and delivers them to the ball ejection component so that the ball ejection component has a continuous supply of balls. The invention includes a means for tracking a predetermined color worn by a player on the court and returning the ball toward the player's current position after a predetermined triggering event has occurred.

15 Claims, 13 Drawing Sheets

(56) References Cited

U.S. PATENT DOCUMENTS

| | | | | |
|---|---|---|---|---|
| 5,537,212 | A * | 7/1996 | Kelly | A63B 63/08 250/226 |
| 5,776,018 | A | 7/1998 | Simpson et al. | |
| 6,056,652 | A * | 5/2000 | Lees | A63B 63/083 473/433 |
| 6,241,628 | B1 | 6/2001 | Jenkins et al. | |
| 7,927,237 | B2 * | 4/2011 | Jenkins | A63B 69/0071 473/431 |
| 8,123,634 | B1 | 2/2012 | Lovett | |
| 8,845,460 | B1 | 9/2014 | Feldstein | |
| 8,852,030 | B2 | 10/2014 | Campbell et al. | |
| 9,717,387 | B1 * | 8/2017 | Szatmary | G06N 3/008 701/23 |
| 9,886,624 | B1 * | 2/2018 | Marty | G06T 7/20 382/100 |
| 10,421,001 | B2 * | 9/2019 | Moore | A63B 47/02 473/436 |
| 2001/0008561 | A1 * | 7/2001 | Paul | G06F 3/017 382/103 |
| 2003/0095186 | A1 * | 5/2003 | Aman | A63B 24/0021 348/162 |
| 2015/0265897 | A1 | 9/2015 | Gordon et al. | |
| 2015/0290516 | A1 | 10/2015 | Joseph et al. | |
| 2017/0178382 | A1 * | 6/2017 | Levin | G06K 9/4652 348/135 |

FOREIGN PATENT DOCUMENTS

| | | |
|---|---|---|
| WO | 9532033 | 11/1995 |
| WO | 2015077351 | 5/2015 |

* cited by examiner

BALL RETURN DEVICE AND METHOD OF USING

CROSS-REFERENCE TO RELATED APPLICATIONS

This application is a Continuation Application of and claims priority to U.S. patent application Ser. No. 15/471,925, entitled "BALL RETURN DEVICE AND METHOD FOR USING," filed Mar. 28, 2017, pending, which application is a non-provisional application claiming priority to U.S. Provisional Application Ser. No. 62/315,095, filed Mar. 30, 2016, the complete disclosures of which are each hereby expressly incorporated by this reference.

BACKGROUND

The present invention relates to a device and method for aiding in the practice of basketball and other games that require a ball to be returned to a player in order to perform repetitive practice routines. The invention may be used in any sport where a ball is returned to or projected toward a player, however, for simplicity the invention will be described herein with reference to basketball.

It is well known that basketball players must spend a great deal of time practicing to become proficient in the game. Because of the large dimensions of the basketball court, however, much time is wasted chasing stray balls after they have passed through the basket. Such Tasted time is particularly frustrating to an experienced ball player attempting to perfect his technique, since even a properly thrown ball will not return to him after it has passed through the net of the goal. Existing basketball return mechanisms have generally been in the form of passive devices which do no more than direct the ball to preset locations on the court. Such devices do not allow a player to move around the court to practice different shots because the players are limited by the restrictions of the drill preprogrammed into the device.

Some types of existing ball return devices track a player's movement on the court, however, these devices use lasers or infrared technology which requires the player to wear a radio transmitter, special reflective clothing, or global positioning system (GPS) device. Players do not like wearing extra equipment during practice because it does not simulate a real game situation. Further, some of these devices (like GPS) do not accurately track the player because the GPS equipment is only calibrated to be accurate within a certain distance (several feet) of the actual target's location.

Further, some type of existing ball return devices are large, heavy, and difficult to set up. This is problematic for players who are practicing by themselves or coaches who wish to quickly set up and take down practice tools during the regular course of a team's practice.

There is therefore a need for a simple and improved ball return device that is able to track the position of a player on the court and return a ball to a player's current position.

SUMMARY

One aspect of the present invention relates to a device for aiding in the practice of basketball and other games which require a ball to be returned to a player in order to perform repetitive practice routines. The device generally includes a ball catching component and a ball ejection component. The ball catching component catches balls thrown by the player and delivers them to the ball ejection component so that the ball ejection component has a continuous supply of balls.

The ball catching component generally includes a net assembly capable of being raised and lowered along a support post. The net assembly includes a net supported by a one or more support arms. In use, the net assembly is raised under a basketball hoop to catch made and missed balls and funnel them into the ball ejection component. The ball ejection component generally includes a first opening for receiving basketballs from the ball catching component and a second opening for ejecting basketballs toward the player. The ball ejection component has a turret portion rotatable around a base portion by a motor. The rotation of the turret portion allows the ball ejection component to change the direction that the ball is ejected from the device. A sensor capable of identifying and tracking a pre-programmed color worn by the player is in communication with a processor. The output of the sensor provides a signal which is used by control circuitry to cause the second opening in the turret portion of the ball ejection component to rotate as the player moves and to eject a ball toward the player. In this manner, the player can wear the pre-programmed color so that the balls are always ejected toward the player no matter where the player is on the court. Inside the ball ejection component is a ball storage track where several basketballs may be queued for ejection. A first wheel and second wheel are positioned on opposite sides of the queued balls and each spun by one or more motors in opposite directions. The ball storage track has a gate which releases a basketball down the track and into communication with the first and second wheel for ejecting the ball through the second opening of the ball ejection component toward the player. The gate is in communication with a processor which controls the rate at which balls are released down the track toward the wheels in accordance with the selected practice mode.

Another aspect of the present invention relates to a ball retrieval and return device comprising a ball catching component having a net combined with one or more support arms and a lift bracket movably combined with a support post between a raised position and a lowered position, wherein the support arms are pivotally combined with the lift bracket. Guide members are operatively combined with the support post, wherein each of the guide members receive one of the support arms to direct the support arms upward and outward from the lift bracket. A connecting member such as a strap, rope, or chain has a first end combined with a tensioning member and a second end combined with the lift bracket so that increasing tension on the connecting member moves the lift bracket toward raised position and decreasing tension on the connecting member moves the lift bracket toward its lowered position. The tensioning member may be a winch or a counterweight. The device also includes a ball ejection component having a turret portion rotatable around a base portion, wherein the turret portion includes a first opening for receiving balls from the ball catching component and a second opening for ejecting balls toward a player.

Another aspect of the present invention includes a method for using a ball return device. The processor(s) used with the device described above include a means for tracking a pre-programmed color of a player on the court and returning the ball to the player's current position after a predetermined triggering event has occurred. The triggering events are determined by the player in accordance with the selected practice mode. In some embodiments, the triggering event may include a pre-selected time delay, such as every five or ten seconds. In other embodiments the triggering event may include a predetermined amount of time after the player has stopped moving, such as three seconds after the sensor has determined that the pre-programmed color has stopped moving.

Another aspect of the invention includes a method of using the ball return device described above. The method comprises positioning the ball catching component under a basketball hoop; positioning the ball ejection component under the ball catching component; providing power to the ball ejection component to rotate the wheels; loading the storage track in the ball ejection component with at least one ball; programming the sensor in the turret portion to follow a predetermined color; instructing a processor to eject the ball upon the occurrence of a triggering event; and ejecting the ball toward the player upon the occurrence of the triggering event. The triggering event may be the passage of a predetermined about of time or it may be the lack of movement of the player for a predetermined about of time.

DETAILED DESCRIPTION

Figure 1:
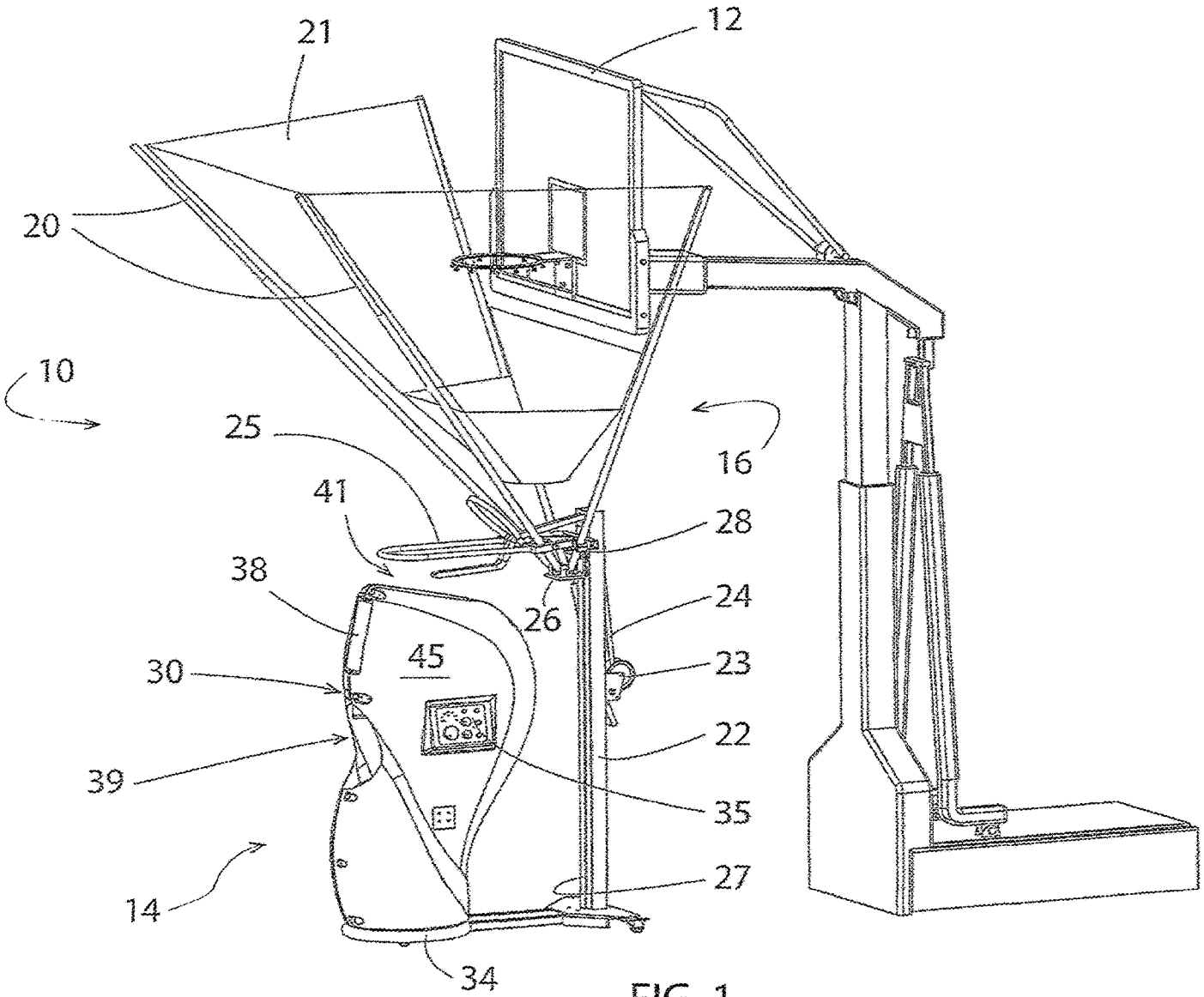
FIG. 1 is a perspective view of an embodiment of the ball return device.
Figure 2:
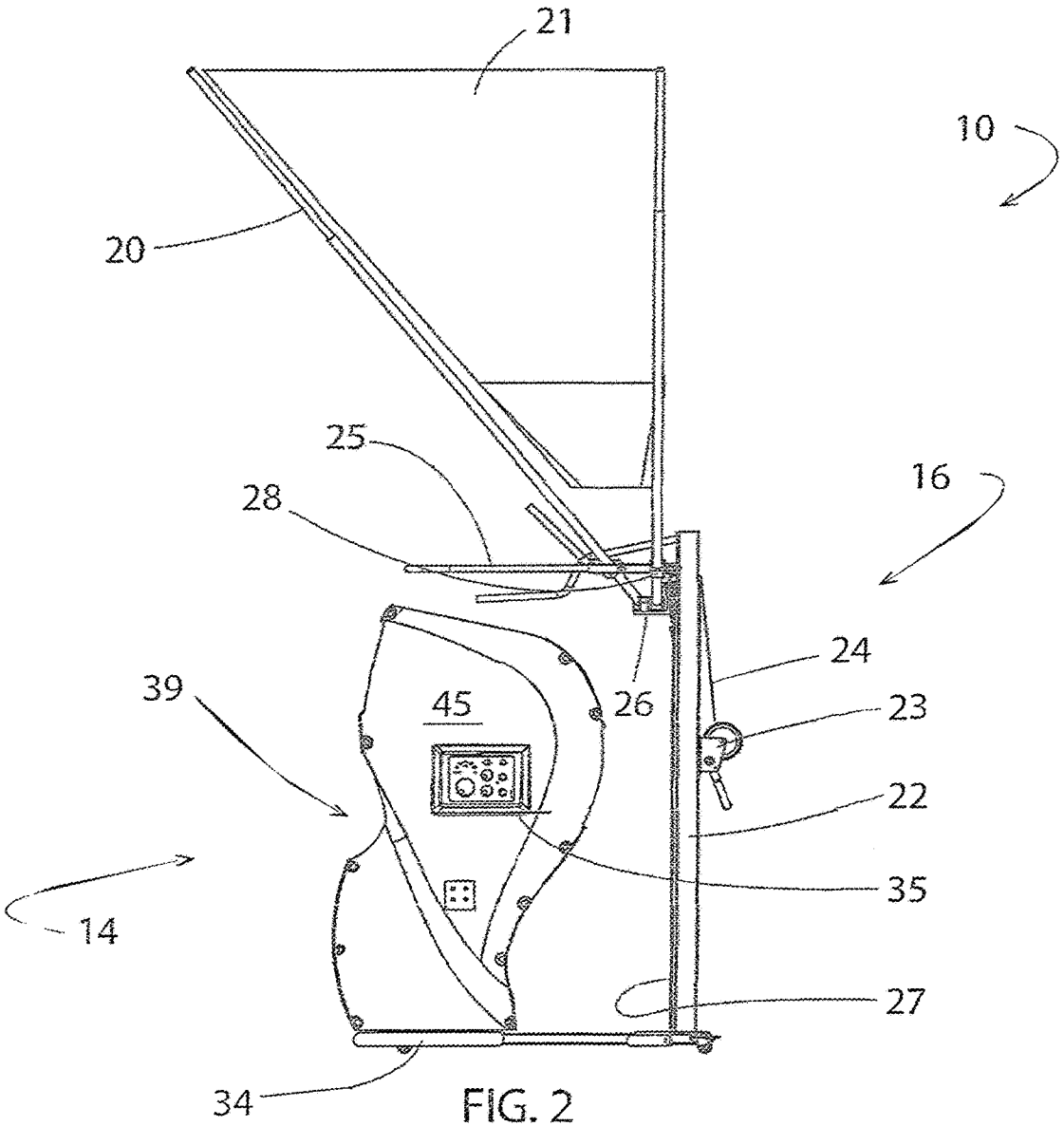
FIG. 2 is a side view of an embodiment of the ball return device.
Figure 3:
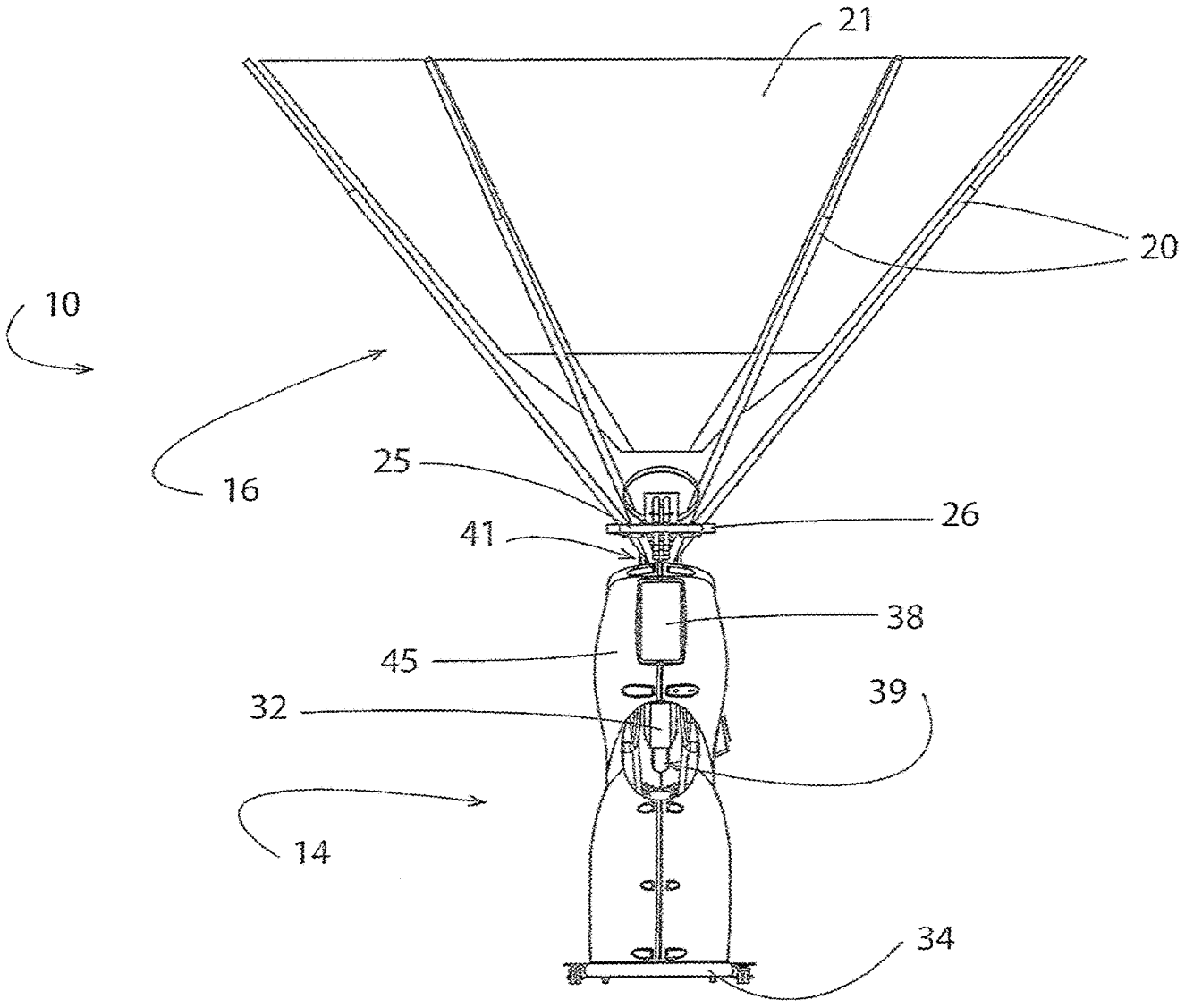
FIG. 3 is a front view of an embodiment of the ball return device.

The present invention relates to a device 10 and method for aiding in the practice of basketball and other games which require the ball to be returned to the player in order to perform repetitive practice routines. FIGS. 1-3 show the general components wherein the device 10 generally includes a ball catching component 16 and a ball ejection component 14. The two components 14, 16 may be separable from each or they may be combined to help ensure proper alignment. FIGS. 6-8, 11, and 12 show further detail of the ball catching component 16. The ball catching component 16 generally includes a net assembly having a net 21 supported by one or more support arms 20. The net 21 may be made from any suitable material, including woven fibers, metal, and plastic. The net assembly is capable of being raised and lowered along a support post 22 as described in more detail below. The net assembly is wide enough around its top perimeter when in its raised position to collect errantly shot basketballs as well as basketballs that ricochet off the basketball backboard and rim, and also basketballs that fall through the rim. In use, the net assembly is raised under a basketball hoop 12 to catch made and missed balls and direct them into the ball ejection component 14 so that the ball ejection component 14 has a continuously replenished supply of balls for ejection toward the player. The net 21 acts as a funnel (La, has a larger horizontal cross-sectional area at its top and smaller horizontal cross-sectional area at its bottom) so that balls drop from an opening in the bottom of the net 21 onto a ball tray 25 which is positioned beneath the net 21. The balls roll along the ball tray and are dropped into a top opening 41 in the ball ejection component 14.

Figure 6:
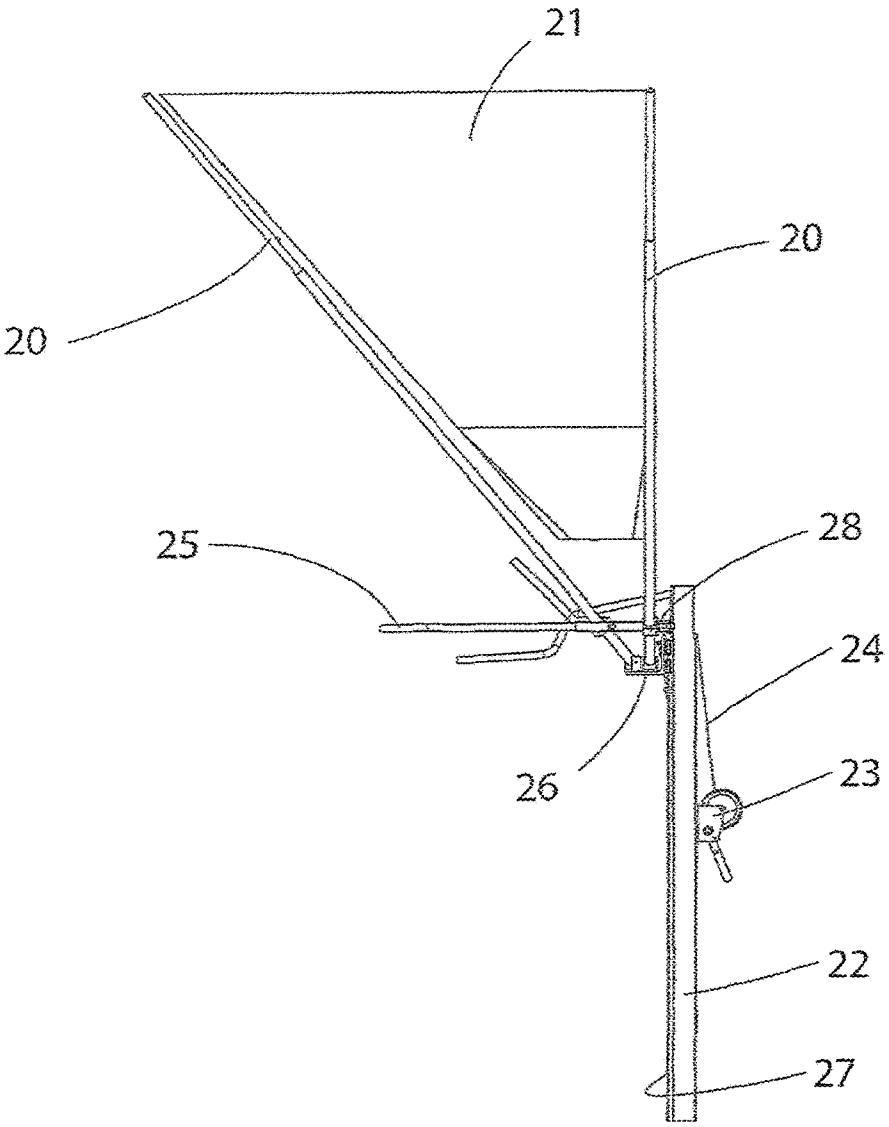
FIG. 6 is a side view of the ball catching component in its raised position.
Figure 7:
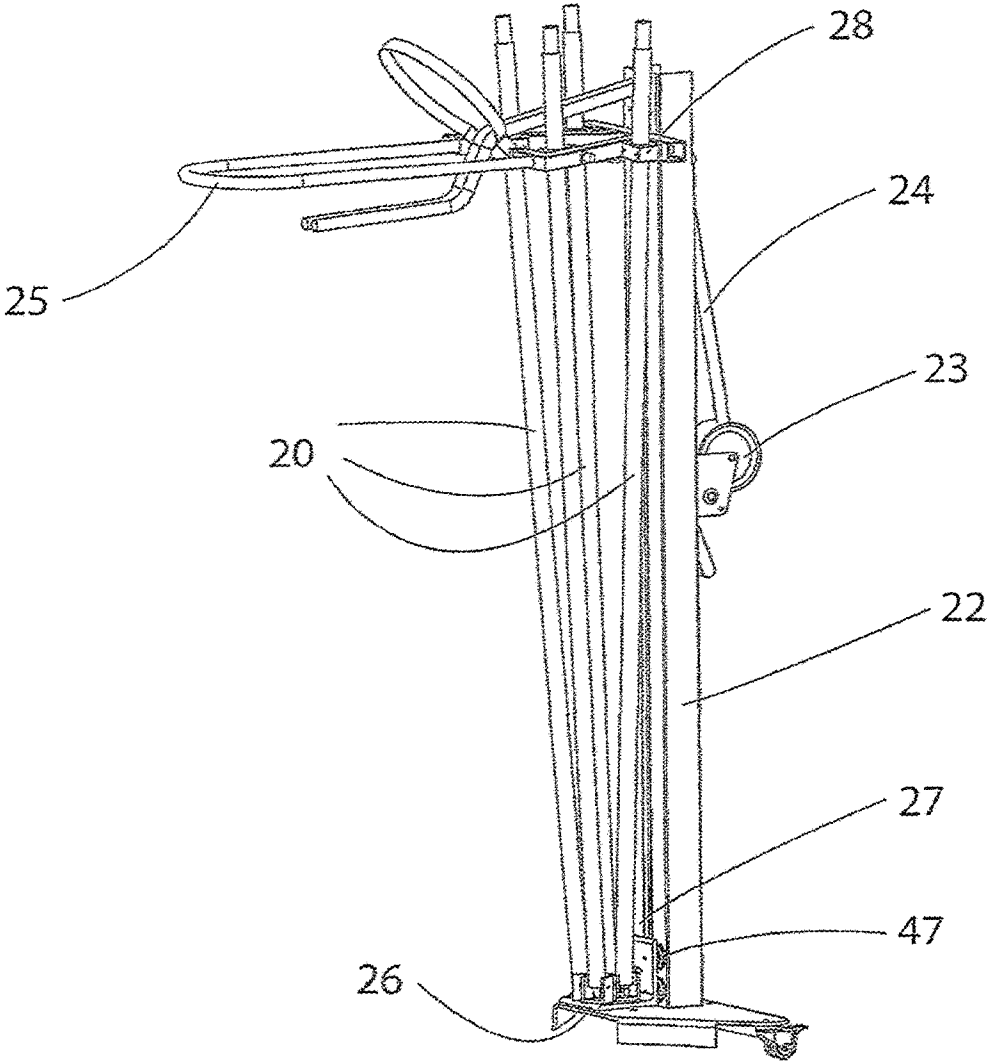
FIG. 7 is a perspective view of the ball catching component in its lowered position.
Figure 8:
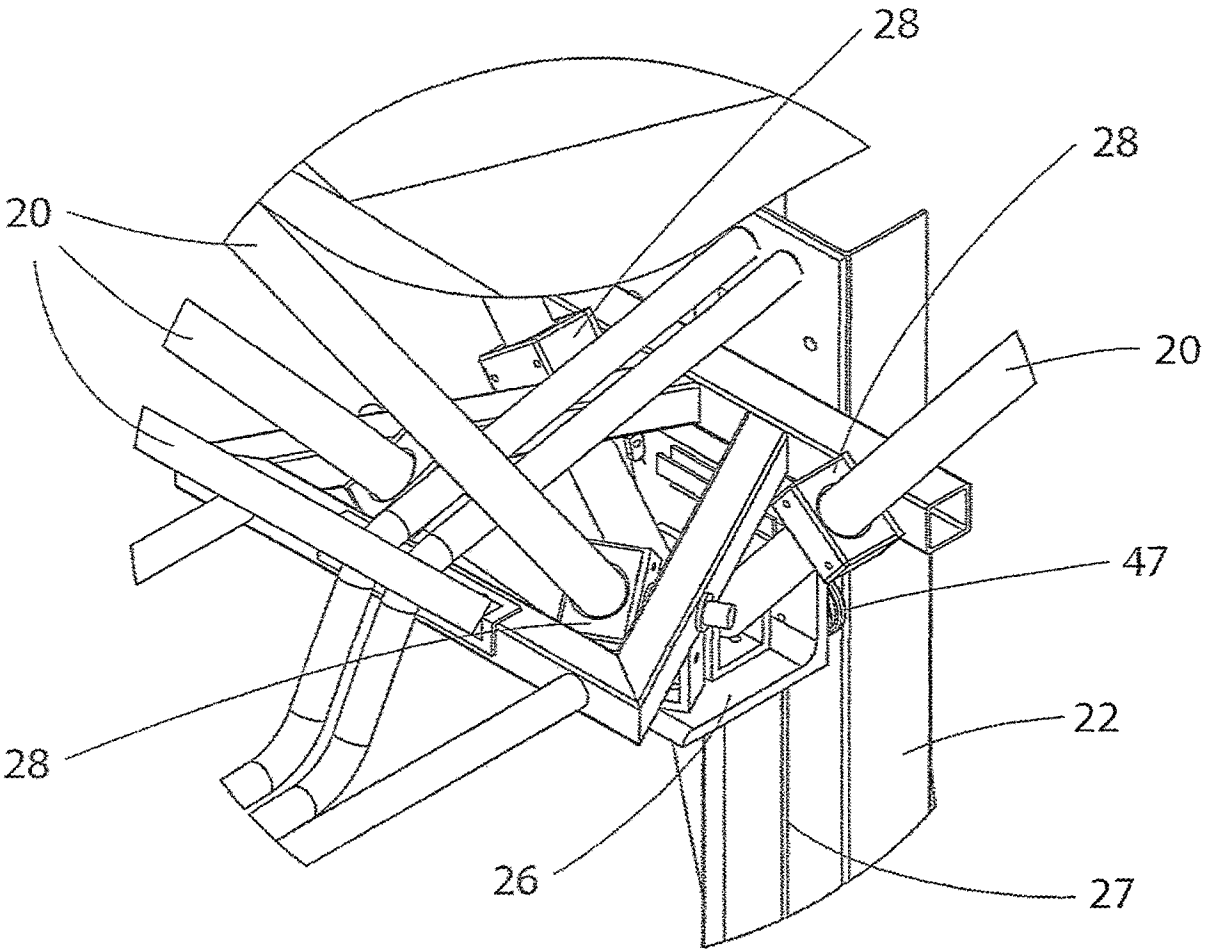
FIG. 8 is a perspective view showing the lift bracket combined with the support post.

FIGS. 1 and 6 show the ball catching component 16 in its raised (use) position and FIG. 7 shows the ball catching component 16 in its lowered (storage) position. The support arms 20 of the net assembly are pivotally combined with a lift bracket 26 near their lower ends. As shown in FIG. 8, guide members 28 are operatively combined with the support post 22 at a predetermined distance above the lower end of the support arms 20. Each guide member 28 is positioned to receive one of the support arms 20 through an opening so that the support arm 20 is angled outward relative to its pivotal connection with the lift bracket 26. The guide members 28 help direct the support arms 20 upward and outward as the lift bracket 26 is raised. The guide members 28 may be pivotally combined with the device allowing the direction of their opening to change as the angle of each respective support arm 20 changes.

Figure 9:
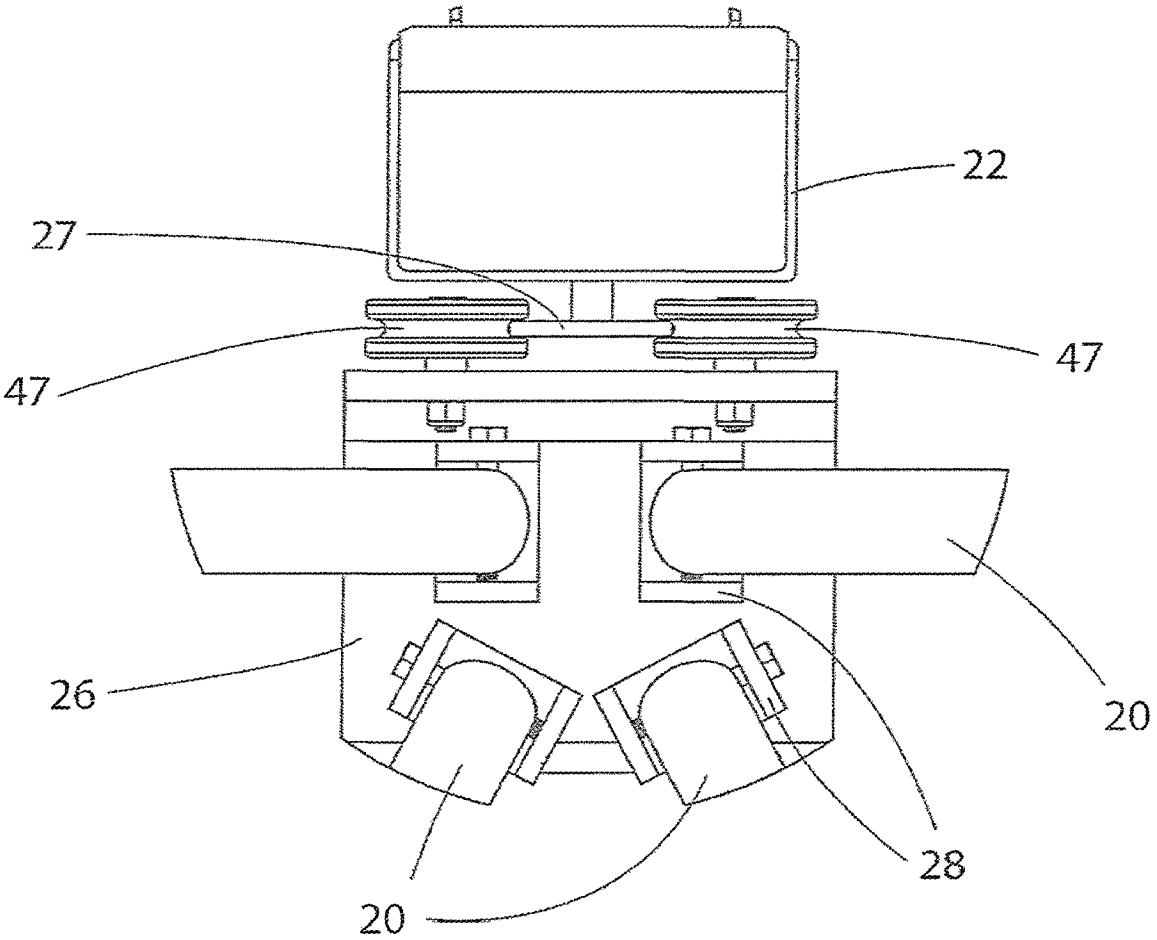
FIG. 9 is a top view showing the connection between the lift bracket and the support post.

The lift bracket 26 is movable vertically along the support post 22, In one embodiment the lift bracket 26 travels vertically along the support post 22 in a track 27. In the embodiment shown in FIGS. 8 and 9, the lift bracket 26 includes pairs of opposed rollers 47 each having a groove that is received by a raised track 27 on the support post 22. This allows the lift bracket 26 to remain attached to the support post 22 as it moves up and down the support post 22. In an alternate embodiment (not shown) the lift bracket 26 includes a receiving member that is received by a vertical groove in the support post 22. The receiving member is larger than the groove's outer opening thereby allowing the receiving member to travel vertically along the groove without being separated from the support post 22.

The lift bracket 26 is raised and lowered along the support post 22 by a connecting member 24 having a first portion and a second portion. The connecting member 24 may be a rope, chain, strap or other suitable member. The first portion of the connecting member 24 is combined with the lift bracket 26 and the second portion of connecting member 24 is combined with a tensioning member. FIGS. 6 and 7 show an embodiment wherein the tensioning member is a winch 23 or other similar device. The winch 23 is combined with the support post 23 as shown in FIG. 2. An intermediate portion of the connecting member 24 extends over a fixed member or pulley near the top of the support post 22. Placing tension on the connecting member 24 (i.e., cranking the winch 23) moves the net assembly from its lowered position to its raised position by pulling the lift bracket 26 upward along the support post 22 toward the fixed member or pulley.

Figure 11:
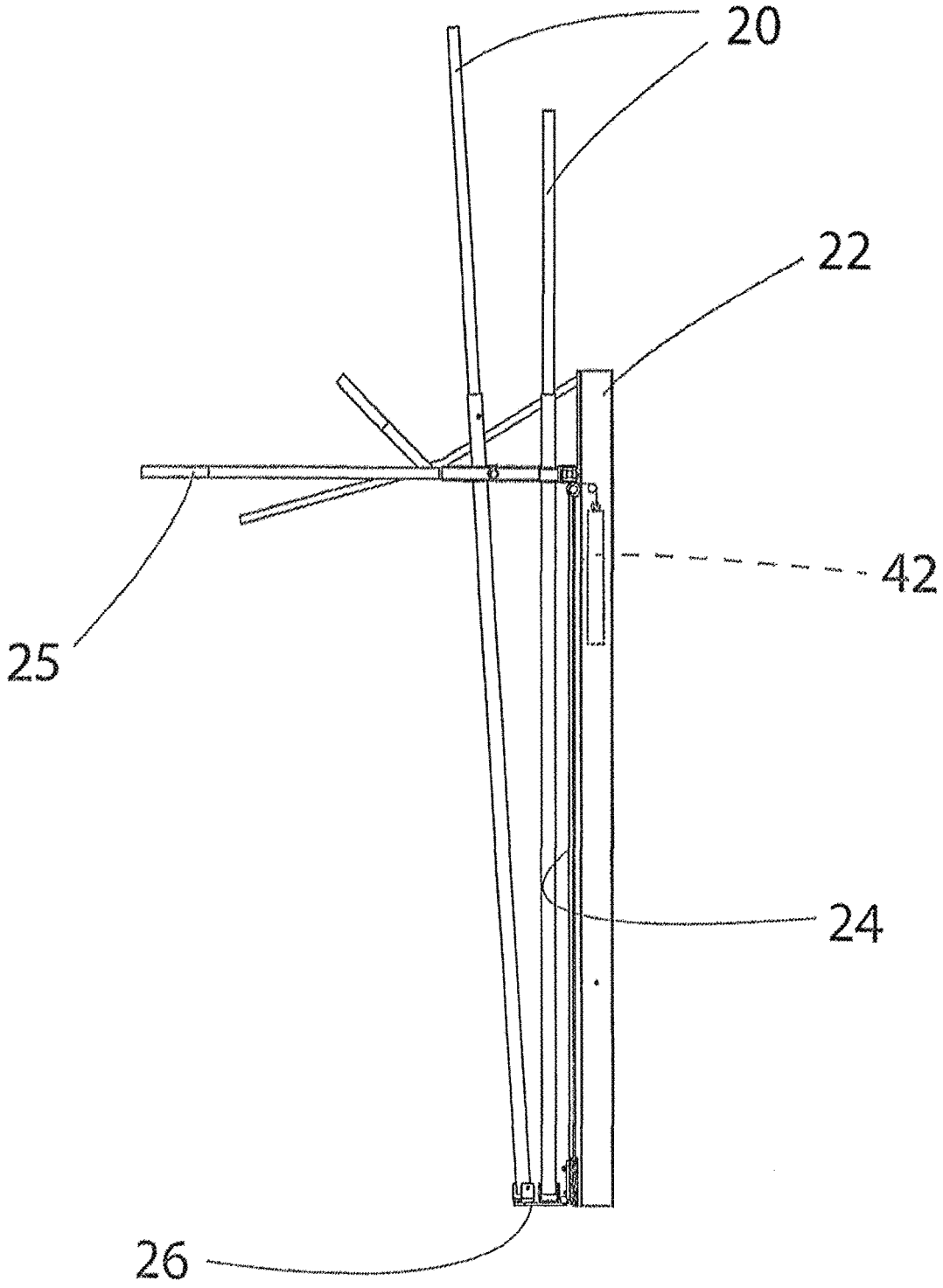
FIG. 11 is a perspective view of an alternate embodiment of the ball catching component in its lowered position.
Figure 12:
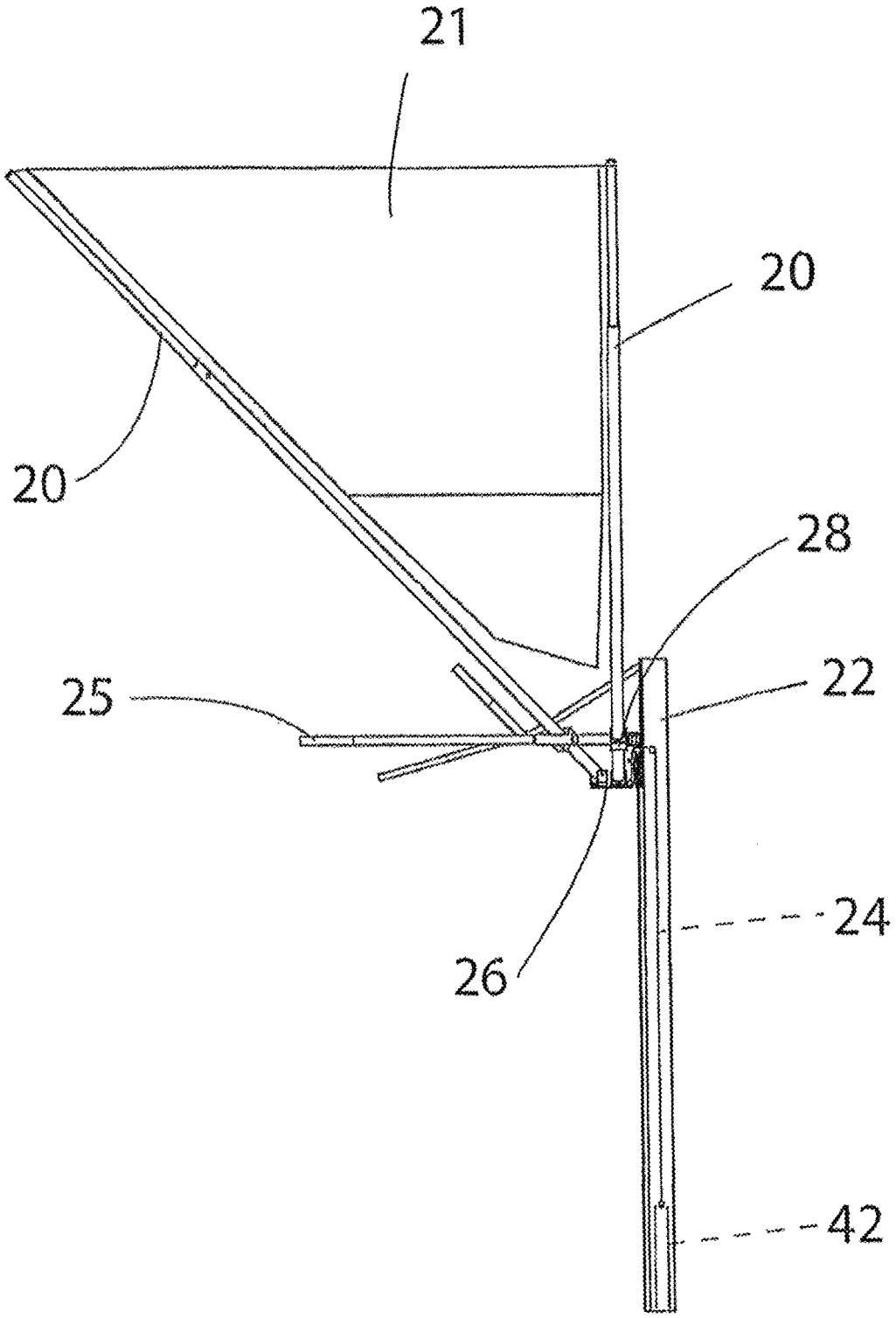
FIG. 12 is a perspective view of the ball catching components of FIG. 11 shown in its raised position.

FIGS. 11 and 12 show an alternate embodiment wherein the tensioning member is a counterweight 42. In this embodiment, the first portion of the connecting member 24 is combined with the lift bracket 26 and the second portion of connecting member 24 is combined with a counterweight 42. In the embodiment shown, the counterweight 42 is enclosed within the support post 22, however, the counterweight 42 need not be inside the support post 22. An intermediate portion of the connecting member 24 extends over a fixed member or pulley near the top of the support post 22. The counterweight 42 helps raise the ball catching component 16 as a user lifts the net assembly and/or lift bracket 26 upward to its extended position and retains the ball catching component 16 in its extended position until the pulls the ball catching component 16 and/or lift bracket 26 toward its lowered position. In one embodiment, the lift bracket 26 includes one or more handles (not shown) to help the user grasp the device for raising and lowering the catching component 16. In one embodiment the device includes a locking mechanism such as a latch which secures the ball catching component 16 in its extended position until released by the user. In one embodiment the counterweight 42 is between twenty and thirty pounds. In one embodiment the counterweight 42 is twenty-five pounds.

As the lift bracket 26 is raised, the guide members 28 direct each support arm 20 outward so that the distance between the top of each support arm 20 increases. In the raised position, the support arms 20 pivot outwardly in different directions to create an expanded perimeter to help catch balls that do not go through the hoop. The cross-sectional area of the support arms 20 incrementally decreases from the top to the bottom of the net assembly to funnel the ball downward and through the opening in the bottom of the net 21, onto the ball tray 25, then into the ball ejection component 14. To move the support arms 20 from their raised position to their lowered position, tension from the winch 23 is released so that gravity causes the net assembly and lift bracket 26 to move downward along the support post 23 to the retracted (storage) position shown in FIGS. 7 and 11. In the embodiment having the counterweight 42, the user pulls down firmly on the lift bracket 26 to overcome the resistance of the counterweight 42 and move the support arms 20 to their lowered position. The guide members 28 bring the tops of each support arm 20 closer together as the lift bracket 26 is lowered.

Figure 4:
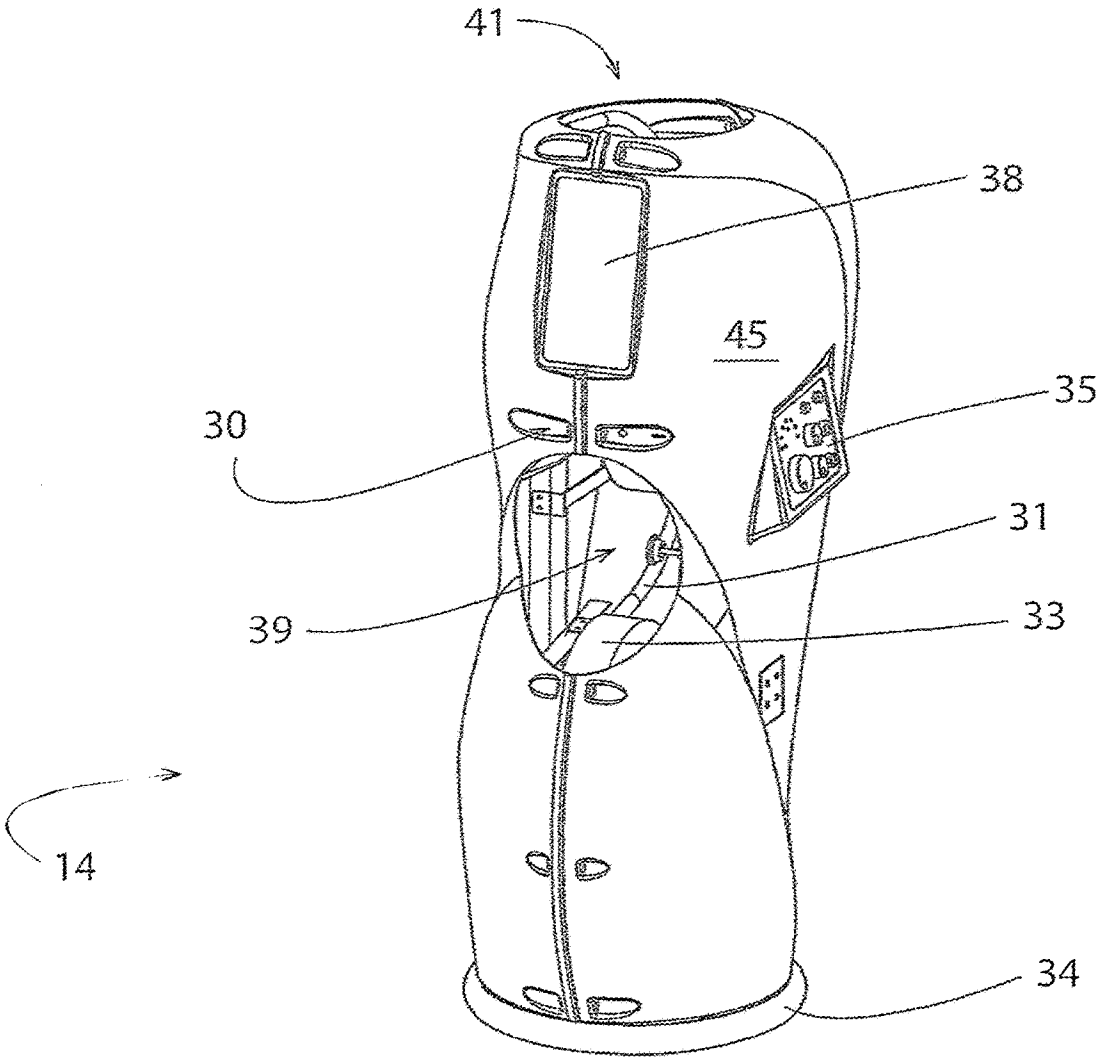
FIG. 4 is a perspective view of the ball ejection component.
Figure 5:
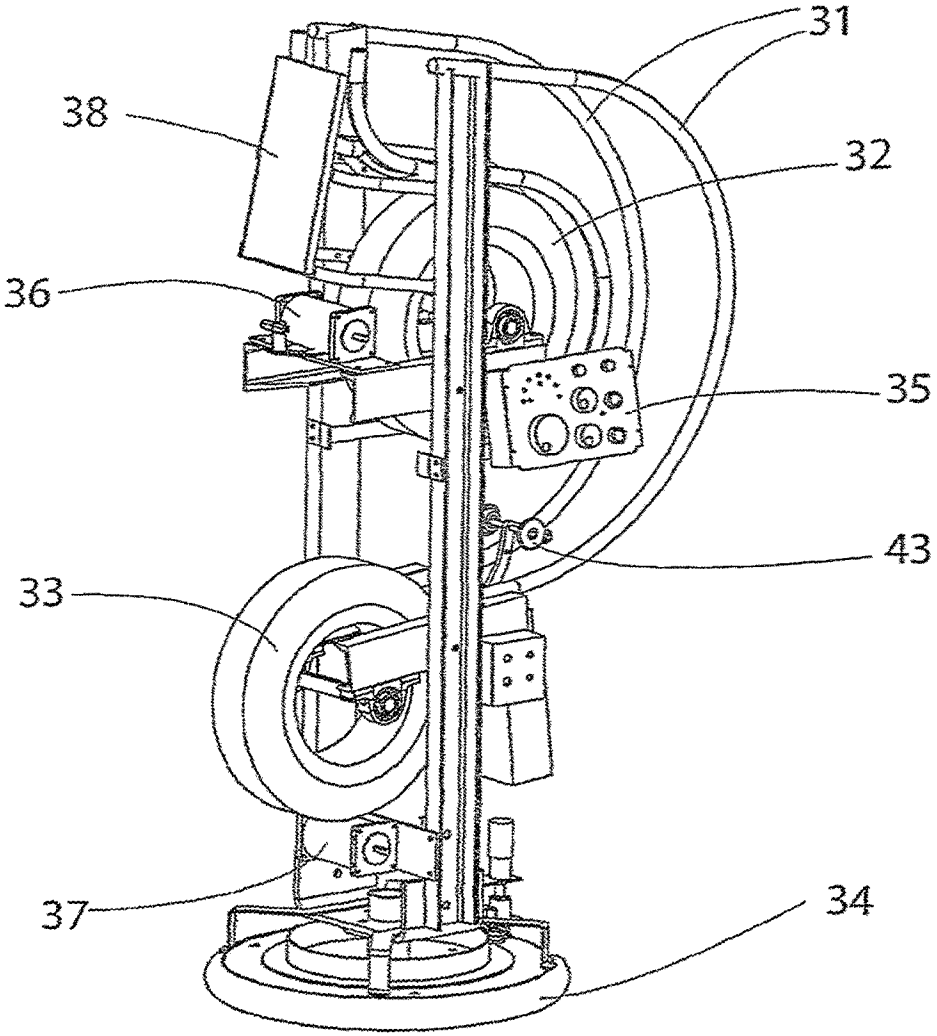
FIG. 5 is a perspective view of the ball ejection component with the housing removed.

FIGS. 4 and 5 show additional detail of the ball ejection component 14. The ball ejection component 14 generally includes a first opening 41 for receiving basketballs from the ball catching component 16 (or another source) and a second opening 39 for ejecting basketballs toward the player. The ball ejection component 14 has a turret portion 45 capable of rotating around a base portion 34 by a motor. The rotation of the turret portion 45 allows the ball ejection component 14 to change the direction the ball is ejected. Inside the ball ejection component 14 is a ball storage track 31 where several basketballs may be queued for ejection toward the player. A first wheel 32 and second wheel 33 positioned on opposite sides of the storage track 31 are each rotated in opposite directions by one or more motors 36, 37. The wheels 32, 33 are capable of launching the ball through the air toward the user as a result of friction between the ball and the surface of the rotating wheels 32, 33. The wheels 32, 33 preferably include a surface with a high friction rate, like rubber, to help grab the ball and eject it from the device 14. The wheels 32, 33 may rotate at the same speed or at different speeds to cause the ball to have backspin or topspin as it travels toward the user. The operation of the wheels 32, 33 is similar to that of baseball pitching machines, which are known in the art. The ball storage track 31 has a gate 43 capable of being opened and closed. In the gate's 43 closed position the next ball in the queue remains stored on the storage track 31. In its open position, the next ball in the queue is released toward the wheels 32, 33 and ejected from the second opening 30 in the ball ejection component 14. The ball release gate 43 is in communication with a processor which controls the rate at which balls are released down the track toward the wheels 32, 33 according to the practice mode selected by the player.

Figure 13:
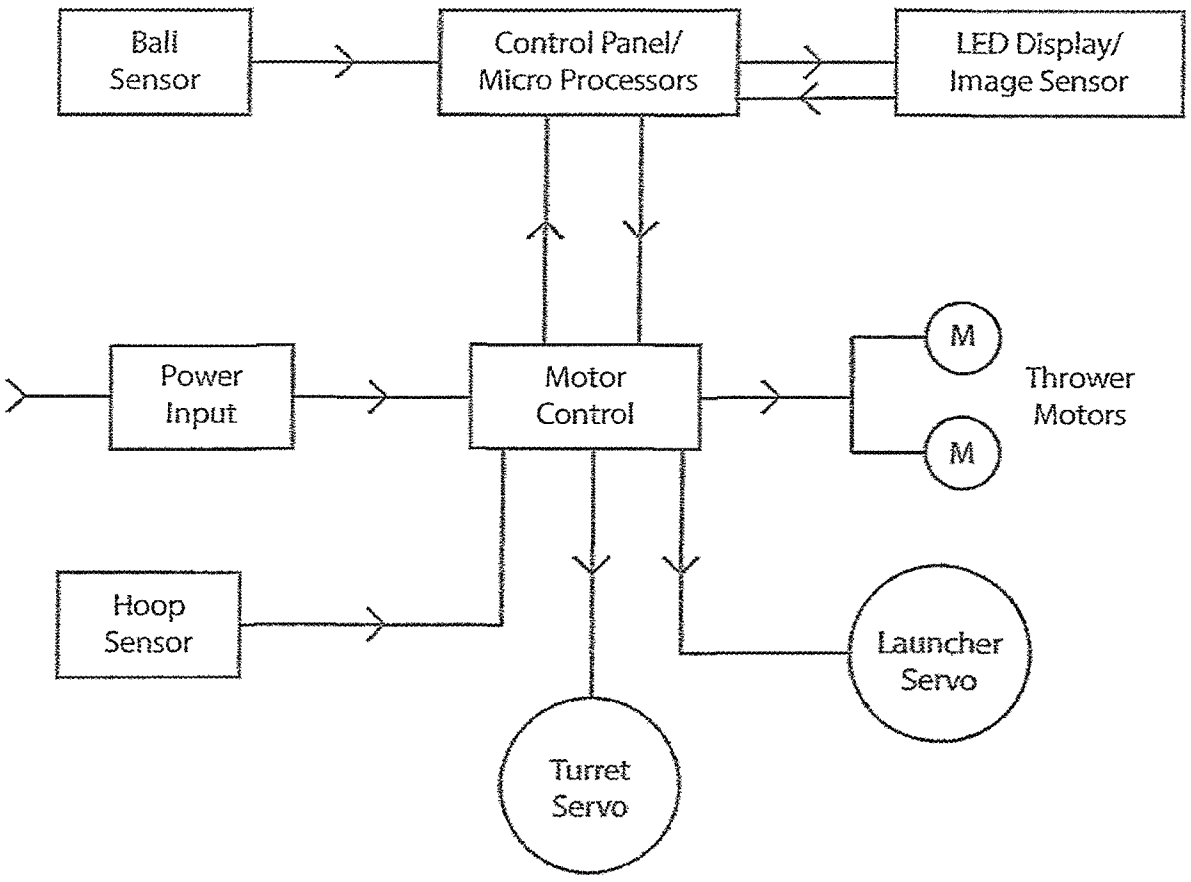
FIG. 13 is a schematic diagram of the digital circuit.

One aspect of the ball return device 10 as described above is capable of delivering a ball to a multiplicity of locations on a playing court. The device 10 includes a sensor 30 for detecting the location of a player on a ball court. The output of the sensor 30 provides a signal which is used by control circuitry to cause the device to eject a ball toward the player. The device 10 tracks a player's movements by the use of a detection and control system which includes microprocessors, software, and sensors. FIG. 4 shows a sensor 30 mounted to the front of the turret portion 45 capable of identifying and tracking a pre-programmed color. The sensor 30 may be positioned at any suitable location where it can see the player, including in the display panel 38. The output of the sensor 30 provides a signal which is used by control circuitry to cause the device to eject a ball toward the player. An exemplary configuration for the control circuitry is shown in FIG. 13. The control circuitry communicates with the motor that rotates the turret portion 45 of the ball ejection component 14 so that the turret portion 45 rotates to always align the second opening 39 with the preprogrammed color. In this manner, the user can wear the pre-programmed color (as a jersey, headband, shorts, pants, hat, etc . . . ) so that the balls are always ejected toward the player no matter where the player is on the court.

In one embodiment, the sensor 30 is a special camera that has the capability to recognize any colored clothing worn by the player which has a distinctive hue. In one embodiment, the distinctive hue is a color which stands out against dull or non-descriptive color such as blacks, whites, grays. The sensor 30 communicates with a circuit board which provides logic to the device. The sensor 30 has a replaceable lens and a dedicated microprocessor to handle the various calculations required to recognize objects as well as output data corresponding to the color, size, and position of the objects within the sensor's 30 field of view. The system can be programmed to recognize different colored objects, as well as differentiate between different sized objects of the same color. The sensor 30 outputs a voltage (typically between about 0-3.5 volts). The voltage correlates with a position within the sensor's field of view in a horizontal plane. As shown in FIG. 4, the sensor may be mounted in a fixed location on the upper area of the rotating turret portion 45 with a clear view of the basketball court and is aligned with the second (ejection) opening 39. The sensor 30 consequently rotates with the turret portion 45 to continually keep its target within its field of view.

In one embodiment, the system includes two microprocessors each programmed for different simultaneous operations. The first processor controls the positioning of the rotating turret portion 45. This processor is programmed to operate a servo gear motor, Biked by a cogged belt, to a rotating platform above the base 34 of the ball ejection component 14. The processor reads data from the sensor 30, makes calculations, and sends signals to the servo gear motor. The gear motor rotates the turret position 45 corresponding with the position data sent from the first processor. This causes the turret 45 to rotate such that the programmed colored object is always kept in the center of the sensor's 30 field of view.

The second processor controls the launch functions. It monitors sensors and sends and receives launch information from the first processor. The second processor opens and closes the gate 43 based on information for the first process and also based on the particular drill selected by the player.

The system includes software which serves several functions. First a software program receives and interprets data from the sensor 30 and controls the position, speed, and direction of rotation of the turret portion 45 of the ball ejection component 14. This software is preferably programmed in the first processor. Second, a software program sends and receives data from the first processor and monitors the various sensors located on the unit. The second software program also controls the ball launching function.

Operation of the device's 10 many functions may be achieved through the user interface 35 and/or by a remote control (not shown). The device has several operational modes. In one mode, the device has preprogrammed drills (non-tracking operation) wherein the device delivers balls to predetermined locations on the court regardless of where the player is located. In another mode, the device tracks a player on the court (auto-tracking operation) according to a distinctive hue worn by the player (as described above). Before an auto-tracking drill can be run, the unit must be programmed to track a particular color worn by the player. It is preferable to use bright vibrant colors (not gray, black, white etc) that are unique to the surroundings (i.e., if there are a lot of green objects in the surroundings use a different color such as orange, blue, yellow etc.). Small objects of the same color as the jersey are usually not a problem if they are considerably smaller. In one embodiment the unit tracks the largest colored object in its field of view.

To train the sensor 30, the player should stand several feet from the sensor 30 with the distinctive hue within the sensor's 30 field of view. Make sure there is not a shadow obscuring the proper color of the distinctive hue you are wearing. The lighting must be adequate for the sensor 30 to recognize the distinct color. Press the "Read" button on the user interface panel 35 once. The LED on the front of the display 38 will flash red several times indicating it is in programming mode. The LED will glow the color of the jersey the player is wearing. If not, either the lighting is not sufficient or the user may need to try a different color. Once a strong color signature is indicated by the LED, click the "Set" button. If the programming recognized the color correctly the LED will flash red three times. The display 38 will glow red if it is sensing the programmed color (after it is programmed the display 38 does not mirror the programmed color, it always glows red). Once a particular color is programmed the unit will remember this color the next time the unit is powered up. If the same color jersey is always used, you will not need to program the unit again unless there are significant changes in the lighting conditions.

There are several auto-tracking modes which may be programmed into the device wherein a ball is only ejected upon the occurrence of a triggering event. A first auto-tracking drill will track the shooter and launch a ball at intervals determined by the setting on the "shot delay" setting. The triggering event in this drill is the passage of a predetermined about of time. The shoot delay setting adjusts the amount of time between successive ball ejections by the device. For example, a ball may be ejected from the device 10 every three, five, or seven seconds. A second auto-tracking drill will track the player and launch a ball only after the shooter stops moving for a predetermined amount of time (typically 1, 2, 3, 4, or 5 seconds). The triggering event in this drill is when the sensor determines that the player has stopped moving for a predetermined about of time. In this second drill the sensor 30 tracks the position of the player on the court and also sends data to the processor about whether the player/color is moving. When the processor determines that the player has stopped moving for the predetermined about of time, then the ball ejection component 14 ejects a ball toward the player's current position. The processor then waits a predetermined amount of time (typically about 2-7 seconds) before again sensing whether the player/color is moving to ensure the player has had enough time to shoot the last basketball. This allows the player to move to a new position on the floor and get set before a new ball is ejected from the ball ejection component 14.

In one embodiment the display 38 will flash a visible warning and the device 10 may emit a sound to alert the player that the drill is about to begin and the device is about the eject a ball toward the player. The warning flash on the display 38 and the audible warning sound will be repeated before each successive ball is ejected.

Figure 10:
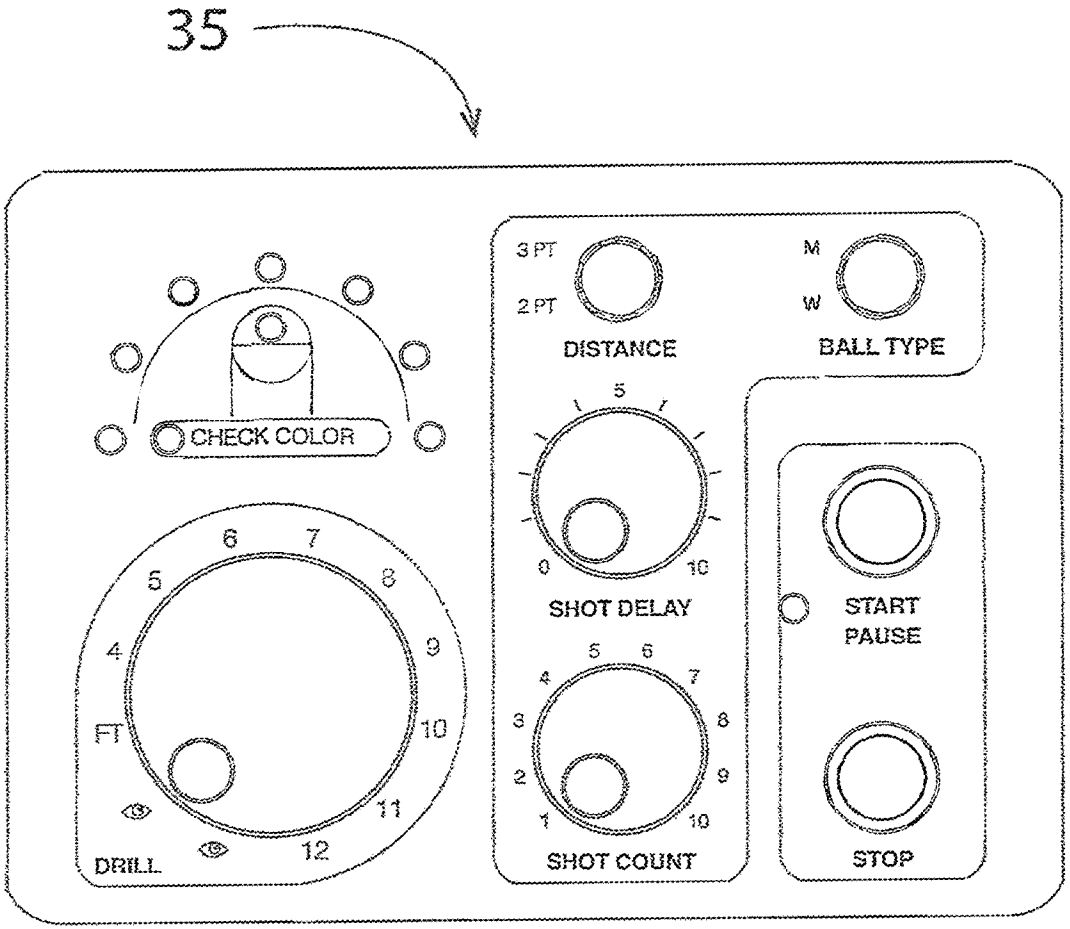
FIG. 10 is a front elevational view of a user interface (control panel).

FIG. 10 shows an exemplary user interface 35 having a drill select knob for selecting different pre-programmed drills. The drill can be stopped and started by using the remote control, or the "start/pause" button on the user interface panel 35. Whenever a drill has been paused and then restarted, the countdown chirp sequence will always follow, and the drill will continue from its current position. The "stop" or "power off" button can be pressed at any time during a drill. This will halt the drill, turn the light bar Blue and return to HOME position before powering off the unit. A distance knob adjusts the speed of the wheels 32, 33 to eject the ball different distances. As shown, the distance may be for a two-point shot or a three-point shot. The user may select a men's or women's "ball type". Since men's and women's basketball balls are different sizes, the device puts more backspin on a women's ball to help slow it down while also ensuring it is ejected the proper distance. The backspin, speed, time interval between balls, and height of the ejected ball may also be controlled by selecting different inputs on the user interface 35.

Having thus described the invention in connection with the preferred embodiments thereof, it will be evident to those skilled in the art that various revisions can be made to the preferred embodiments described herein without departing from the spirit and scope of the invention. Et is my intention, however, that all such revisions and modifications that are evident to those skilled in the art will be included with in the scope of the following claims.

What is claimed is as follows:

1. A method of using a ball return device comprising the steps of:

positioning the ball catching component under a basketball hoop;

positioning the ball ejection component under the ball catching component, wherein the ball ejection component includes a turret portion rotatable around a base portion and a storage track for storing balls before the balls are ejected;

preventing movement of a ball between the ball catching component and the ball ejection component by closing a gate disposed between the ball catching component and the ball ejection component;

allowing movement of a ball between the ball catching component and the ball ejection component by opening the gate;

providing power to the ball ejection component to rotate a pair of wheels in opposite directions;

loading the storage track in the ball ejection component with at least one ball;

programming a sensor in communication with a processor to follow a predetermined color and rotate the turret portion so that the second opening is always in alignment with the predetermined color for ejecting balls toward the predetermined color; and, ejecting the ball from the turret portion upon the occurrence of a triggering event;

wherein the sensor determines the lack of movement of the player and the triggering event is the lack of movement of the player for a predetermined amount of time;

wherein the processor is a first processor, and wherein the first processor is in electrical communication with a second processor.

2. The method of claim 1 wherein the sensor has a field of view and the processor is programmed to rotate the turret to maintain the predetermined color within the center of the sensor's field of view.

3. The method of claim 1 wherein the triggering event is the passage of a predetermined amount of time.

4. The method of claim 1, wherein the second processor is in electrical communication with the gate and controls the preventing movement and allowing movement steps.

5. A method of automatically returning a ball to a user comprising the steps of:

catching a ball in a ball catching component;

preventing delivery of the ball from the ball catching component to a ball ejection component by closing a gate disposed between the ball catching component and the ball ejection component;

allowing delivery of the ball from the ball catching component to a ball ejection component by opening a gate;

sensing a position of a predetermined color with a sensor disposed on the ejection component;

tracking the predetermined color by rotating a turret on the ejection component in response to the sensing of a change in position of the predetermined color;

aligning the ejection component h the tracking of the predetermined color by rotating the turret;

ejecting the ball toward the predetermined color upon the occurrence of a triggering event;

communicating tracking instructions from a first processor to the sensor;

communicating launch information from the first processor to a second processor; and communicating opening and closing instructions from the second processor to the gate.

6. The method of claim 5, wherein the ball ejection component is disposed below the ball catching component.

7. The method of claim 6, wherein the turret includes a first opening for receiving balls from the ball catching component, and a second opening for ejecting balls from the ball ejection component.

8. The method of claim 7, wherein the aligning the ejection component comprises aligning the second opening with the sensed position of the predetermined color.

9. The method of claim 5, further comprises the steps of:

rotatably attaching the ejection component about a stationary base; and rotating the ejection component about a stationary base.

10. The method of claim 5, wherein the ejecting the ball step is accomplished by the rotation of a pair of wheels.

11. The method of claim 10, wherein the pair of wheels rotate in opposite directions.

12. The method of claim 5, wherein the second processor opens the gate only after the first processor determines that the predetermined color has stopped moving for a predetermined amount of time.

13. The method of claim 5, further comprising the steps of:

raising a lift bracket attached to support arms located on the catching component; and guiding the support arms upwardly and outwardly with guide members disposed on the catching component.

14. The method of claim 13, wherein the catching component further comprises a winch attached to the lift bracket to ease the raising of the lift bracket.

15. A method of returning a ball to a user comprising the steps of:

sensing a position of a predetermined color with a sensor;

communicating the position of the predetermined color from the sensor to a first processor;

aligning an ejection component by communicating the position of the predetermined color to a motor fixedly attached to a base and operatively coupled to a turret, and correspondingly rotating the motor with the position of the predetermined color;

catching a ball in a ball catching component;

communicating launch information from the first processor to a second processor in electrical communication with a gate;

preventing delivery of the ball from the ball catching component to a turret by closing a gate disposed between the ball catching component and the turret;

allowing delivery of the ball from the ball catching component to the turret by opening the gate; and ejecting the ball from the turret toward the predetermined color upon the occurrence of a triggering event;

wherein the triggering event comprises the first processor determining that the predetermined color has stopped moving for a predetermined amount of time.

* * * * *